US005168631A

United States Patent [19]

Sherman

[11] Patent Number: 5,168,631

[45] Date of Patent: Dec. 8, 1992

[54] SIGHT

[76] Inventor: James R. Sherman, 710B Linden Ave., Lewiston, Id. 83501

[21] Appl. No.: 893,939

[22] Filed: Jun. 5, 1992

Related U.S. Application Data

[63] Continuation-in-part of Ser. No. 702,969, May 20, 1991.

[51] Int. Cl.[5] ..... F41G 1/467

[52] U.S. Cl. ..... 33/265; 33/241

[58] Field of Search ..... 33/265, 241, 242, 243, 33/233

[56] References Cited

U.S. PATENT DOCUMENTS

| | | | |
|---|---|---|---|
| 2,256,411 | 9/1941 | Russell | 33/241 |
| 2,430,469 | 11/1947 | Karnes | 33/241 |
| 4,220,983 | 9/1980 | Schroeder | 33/265 X |
| 4,977,677 | 12/1990 | Troescher | 33/265 |

FOREIGN PATENT DOCUMENTS

| | | | |
|---|---|---|---|
| 299159 | 1/1920 | Fed. Rep. of Germany | 33/233 |
| 1582526 | 1/1981 | United Kingdom | 33/242 |

*Primary Examiner*—Harry N. Haroian

*Attorney, Agent, or Firm*—James D. Givnan, Jr.

[57] ABSTRACT

An archery bow sight is disclosed having a tubular member within which are plate members disposed in intersecting planes. Sight components are of transparent plastic having a fluorescent dye dispersed therein. The tubular member and plate member surface areas absorb light waves and conduct the waves to their respective edges to provide a brilliant reticle for use in low light conditions without reliance on artificial light sources. The mounting plate receives a base of the sight in an adjustable manner. Ultraviolet light waves are converted by the sight into visible light waves.

2 Claims, 1 Drawing Sheet

SIGHT

BACKGROUND OF THE INVENTION

This is a continuation-in-part of copending U.S. patent application Ser. No. 07/702,969 filed by the present inventor on May 20, 1991.

The present invention pertains generally to sights of the type such as those found on bows.

A problem with known sights include that of delineating the target from the sight in low light conditions such as is encountered during the early morning and late afternoon hours. Previous attempts at solving this problem have included the addition of artificial light sources to bow mounted sights. Such sight modification is objectionable from reliability and cost standpoints. Further, several states have enacted prohibitions against bow sights using an artificial light source. Some examples of artificially lighted bow sights are found in U.S. Pat. Nos. 4,977,677; 4,400,887; 4,177,572; 4,170,071; 4,166,324 and 3,945,127.

The present inventor's earlier issued U.S. Pat. No. 4,920,394 utilized fiber optics to conduct natural light to a sight pin.

SUMMARY OF THE PRESENT INVENTION

The present invention is embodied in a weapon sight utilizing light collecting and conducting components particularly suited for use in low light conditions.

A tubular member and internal plate means collect light and conduct same toward edges viewed during use of the sight and which emit bright fluorescent light to facilitate aiming of the sight particularly when natural lighting is minimal. Natural light collected by the present sight components is conducted toward the edges of the present sight which emit same. The surface area to edge area ratio of the components assures brilliant viewed edges of the sight without reliance on an artificial light source. Accordingly wires, switches, batteries, diodes, etc., may be dispensed with to enhance sight reliability while reducing the cost of sight manufacture and installation.

Important objectives of the present sight include the provision of a sight with multiple flat and curved light collecting surfaces arranged to collect, conduct and convert light rays into longer visible wavelengths while directing same to edges of the sight viewed by the user during sighting in on a target; the provision of a sight of monolithic construction having both planar and curved surfaces to promote collecting of light and to provide a set of edges conducive to the aiming of a bow or other weapon under a wide range of lighting conditions; the provision of a sight suited for use when game must be stalked in forested areas having heavy undergrowth where lighting conditions, even on a bright day, are marginal for target definition.

BRIEF DESCRIPTION OF THE DRAWINGS

In the accompanying drawings.

DETAILED DESCRIPTION OF THE PRESENT INVENTION

Figure 1:
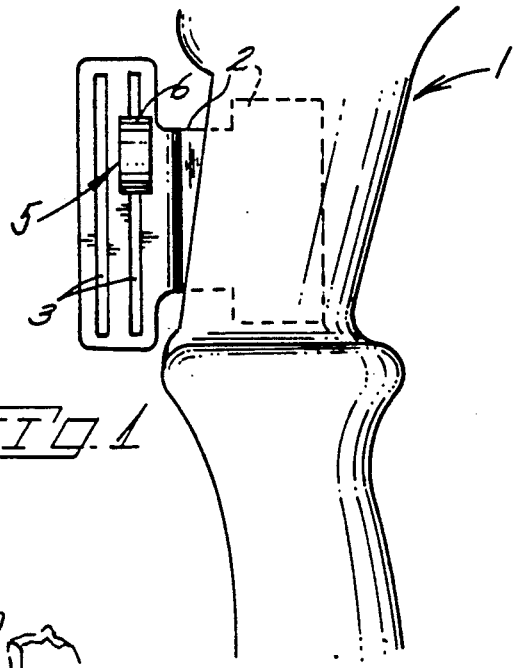
FIG. 1 is a fragmentary side elevational view of a bow with the present sight in place thereon.

With continuing attention to the drawings, the applied reference numeral 1 indicates generally the riser of an archery bow on which is carried a mounting plate 2 which may be of conventional design. Such plates typically have elongate, upright slots as at 3, for installation of a sight thereon.

The present sight is indicated generally at 5. A continuous or tubular member 6 has an outer surface 7 and an inner surface 8. A base at 4 serves to couple member 6 to earlier described mounting plate 2. For lateral or windage adjustment of the present sight base 4 may include a threaded shaft and elements 4A. Other mounting plate attachment arrangements may, of course, be utilized.

A reticle includes plate means indicated generally at 10 arranged to lie in intersecting planes with the intersection of same for registration with a target. Primary surfaces 11 on plate members 12 serve to absorb light and provide relatively large surface areas when compared with the edge areas at 12A of the plate members. Similarly, primary inner and outer surface areas 7 and 8 of tubular member 6 are of substantially greater area than the total surface area of continuous edge 9 of the tubular member. Plate members 12 and tubular member 6 are of monolithic construction and hence are integral or merge at the plates outer extremities with the inner surface 8 of tubular member 6, while at their inner extremities, they merge to form a bead 13 for registration with a target. Such a bead may be of somewhat greater section, as shown, than the intersecting plate members.

Figure 4:
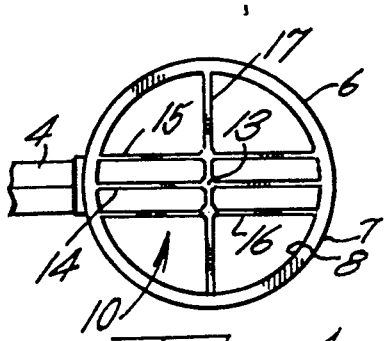
FIG. 4 is a view similar to FIG. 3 but showing a modified form of the present sight.
Figure 2:
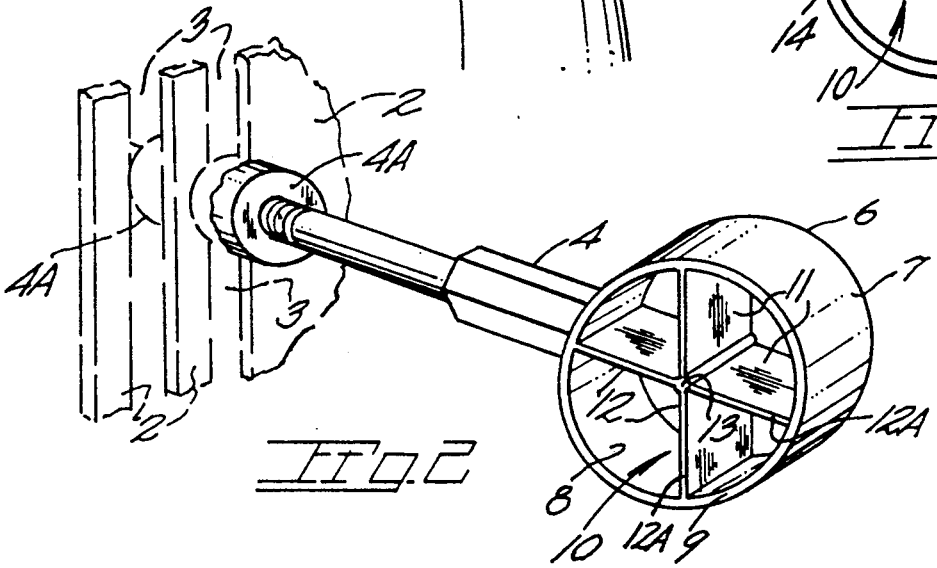
FIG. 2 is a perspective view of the present sight with a bow attached mounting plate shown in phantom lines.
Figure 3:
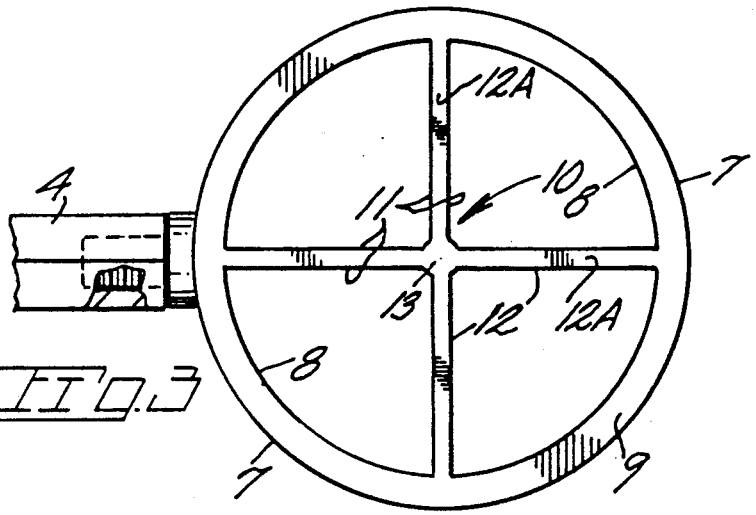
FIG. 3 is a front elevational view of the present sight.

In FIG. 4 a modified sight is shown wherein additional or supplemental horizontal plate members at 15 and 16 are included for providing the user additional target ranging references. Additionally each intersection of the plate members 15 and 16 with a central plate member 17 may be utilized as a bead.

A preferred material for the plate members 10 as well as tubular member 6 is a transparent polymer having a fluorescent dye. Light absorbed by such material is, to a large extent, reflected internally and transmitted or conducted through the polymer until an external edge 9 or 12A is encountered whereat it emerges to provide an edge of significantly greater brilliance than surface areas 7–8 of the tubular segment and surface areas 11 of the plate members. One such suitable plastic is that polymer sold under the trademark LISA, a registered trademark of Bayer AG., of which the Mobay Corporation of Pittsburgh, Pa., is a division. Maintaining a ratio of approximately 14:1 of the combined primary surface areas of the tubular member and plate members to the edge surfaces of same assures bright edge illumination even in low natural light.

Sight construction is preferably by injection molding to provide a monolithic structure to achieve the desired light conductance from ring 6 to the plates 12. Other types of construction may include molding by extrusion to provide a monolithic structure.

While I have shown but a few embodiments of the invention, it will be apparent to those skilled in the art that the invention may be embodied still otherwise without deparing from the spirit and scope of the invention.

Having thus described the invention, what is claimed is:

1. A sight comprising in combination, a base adapted for attachment to a support, a tubular member on said base and of transparent plastic with a fluorescent dye dispersed therein, said tubular member having an inner wall surface, a reticle including plate members of transparent plastic with a fluorescent dye dispersed therein, said plate members terminating at their ends in mergence with said inner wall surface of said tubular member, said plate members additionally in mergence with one another and thereat constituting a bead for the sight, said tubular member and said reticle of molded monolithic construction to enhance the conduction of light from the tubular member to said plate members, said transparent plastic and fluorescent dye dispersed in said plate members providing said tubular member and said plate members with viewable edges of greater fluorescence than the remaining surfaces of said tubular member and said plate members, said plate members receiving both ambient light and light waves collected and conducted by said tubular member to render the plate viewable edges highly visible in low ambient light conditions.

2. The sight claimed in claim 1 additionally including a supplemental horizontal plate member in said tubular member and of transparent plastic with a fluorescent dye dispersed therein and disposed parallel to one of said plate members.

* * * * *